US008591826B2

(12) United States Patent
Auer et al.

(10) Patent No.: US 8,591,826 B2
(45) Date of Patent: Nov. 26, 2013

(54) APPARATUS FOR STERILIZING CONTAINERS TRANSPORTED CONTINUOUSLY IN SUCCESSION

(75) Inventors: Dirk Auer, Meerbusch (DE); Detlef Marten, Erkelenz (DE)

(73) Assignee: SIG Technology AG (CH)

( * ) Notice: Subject to any disclaimer, the term of this patent is extended or adjusted under 35 U.S.C. 154(b) by 1078 days.

(21) Appl. No.: 11/992,564

(22) PCT Filed: Sep. 22, 2006

(86) PCT No.: PCT/EP2006/066645

§ 371 (c)(1),
(2), (4) Date: Aug. 14, 2009

(87) PCT Pub. No.: WO2007/036492

PCT Pub. Date: Apr. 5, 2007

(65) Prior Publication Data

US 2010/0021359 A1 Jan. 28, 2010

(30) Foreign Application Priority Data

Sep. 30, 2005 (DE) ..... 10 2005 047 427

(51) Int. Cl.
*A61L 2/00* (2006.01)
*A61L 2/26* (2006.01)

(52) U.S. Cl.
USPC ..... 422/300; 422/304

(58) Field of Classification Search
USPC ..... 422/300, 304
See application file for complete search history.

(56) References Cited

U.S. PATENT DOCUMENTS

| | | | | |
|---|---|---|---|---|
| 5,879,648 | A | 3/1999 | Hada et al. | |
| 6,032,438 | A * | 3/2000 | Sanfilippo et al. | 53/432 |
| 6,691,747 | B1 * | 2/2004 | Marcus et al. | 141/7 |
| 2006/0008383 | A1 * | 1/2006 | Moller et al. | 422/62 |

FOREIGN PATENT DOCUMENTS

| | | | |
|---|---|---|---|
| DE | 38 09 855 | A1 | 2/1989 |
| DE | 40 31 472 | A1 | 4/1992 |
| DE | 102 13 343 | A1 | 10/2003 |

OTHER PUBLICATIONS

International Preliminary Report on Patentability for International application No. PCT/EP2006/066645, of which U.S. Appl. No. 11/992,564 is a national stage application.

* cited by examiner

*Primary Examiner* — Lyle Alexander
(74) *Attorney, Agent, or Firm* — Wood, Phillips, Katz, Clark & Mortimer

(57) ABSTRACT

An apparatus for sterilizing upright containers which are open at the top and transported continuously in succession, which includes a housing a housing with several successively arranged treatment zones, a transport device with several successively arranged receiving spaces, wherein the transport device or the parts thereof forms or form the bottom of the housing. The housing has a fixed channel which is open at the bottom for the passage of the containers, at least one media distribution chamber with perforations at its bottom is provided above the channel in each treatment zone, and distribution members coupled with the transport device are provided above the containers.

9 Claims, 2 Drawing Sheets

APPARATUS FOR STERILIZING CONTAINERS TRANSPORTED CONTINUOUSLY IN SUCCESSION

FIELD OF THE INVENTION

The invention relates to a device for sterilising containers, which stand upright, are open at the top and transported continuously one behind the other, in particular cardboard/plastics composite packagings for receiving drinks and/or foodstuffs, comprising a housing having a large number of treatment areas arranged one behind the other and a transporting device having a large number of receiving places arranged one behind the other, the transporting device or its parts forming the base of the housing.

BACKGROUND OF THE INVENTION

In practice, devices configured as longitudinal runners, for sterilising containers transported continuously one behind the other are known, in which no "clean" separations are present between the individual sterilisation stations. In these known devices, the sterilising medium is blasted onto the container opening and not introduced into the individual containers in a targeted manner. In some circumstances this can lead to problems with the sterilisation.

A further sterilising device is known from DE 40 31 472 A1. In this case, the device, like the above-mentioned prior art, comprises, in the interior of its housing, a plurality of treatment areas, in which the different process media are introduced into the containers. Sluices are present between the individual areas to seal the areas from one another. The sluices are designed, in this case, in such a way that the containers themselves assume the sealing from the respectively adjacent area. It is obvious that this type of sluices cannot be a complete partitioning owing to the moving containers and that it can only be used for a certain container size.

In a device known from DE 102 13 343 A1 for sterile filling of containers, sterile process gas is guided into an annular channel and flows from there via openings into the treatment space.

A method for sterile filling of liquid goods into containers is known from DE 38 09 855 A1, in which the containers are charged with a sterilisation medium prior to filling, the containers, below the media supply, being partially surrounded by a bell which guides the sterile medium to the outside of the container.

BRIEF SUMMARY OF THE INVENTION

The object of the invention is to configure and develop the device, which is mentioned at the outset and described in more detail above, for sterilising containers, which stand upright, are open at the top and transported continuously one behind the other, in such a way that the before-mentioned drawbacks are avoided, so that the containers in the individual handling areas are charged in a defined manner with the process media supplied there.

This object is achieved in the device according to the invention in that the housing has a fixed channel, which is open toward the bottom, for the passage of the container, in that at least one media distribution space provided with apertures toward the bottom, is provided in the upper region of the channel in each treatment area and in that distribution members coupled to the transporting device, by which the containers in the treatment areas are charged with the respective process media, are provided above the containers.

The solution according to the invention is a simple design, as all the units and devices for producing and monitoring the process media can be installed stationarily and expensive sluice feed-throughs which are liable to wear are not required. The paths for the process media used are very short, so that the process parameters can be controlled in a manner with very low losses. The individual treatment areas (preheating area, sterilisation area and drying area) operate reliably without overlapping and following directly one after the other, so that a spatially very compact mode of construction is produced.

A further teaching of the invention provides that the transporting device has a rotating system with a transporting wheel receiving the containers and that the housing is annular. It is thus achieved that, within the sterilisation process, all the process members are permanently actively also sterilised owing to the constantly repeated cyclic circulation. Furthermore, the round runner construction is a particularly compact design.

All the containers are preferably transported individually one behind the other, in particular in the case of smaller systems. However, according to an alternative embodiment of the invention, it is also possible for a plurality of containers standing next to one another in each case to be transported and sterilised in paths one behind the other.

Expediently, in the embodiment as a round runner, according to a further teaching of the invention, the distributing members are arranged on an annular element. This annular element is preferably rigidly connected to the transporting device, so no relative speed between the containers and the distributing members arranged thereabove can occur. Moreover, in an advantageous embodiment of the invention, each distributing member has a tubular nozzle arranged centrally over the associated container.

A further configuration of the invention provides that the gaps between the fixed housing and the moving transporting device are sealed with sealing elements. The leakage of these functional gaps can be minimised thereby.

A further teaching of the invention provides that a hood element rigidly connected to the distributing member is provided above each container. This hood element has a double function: on the one hand, it is used for controlled introduction of the process media in to the containers and is configured for this in such a way that the process media leaving the container upwardly are deflected in such a way that they can flow off over the edges and outsides of the containers. On the other hand, the hood shape brings about a laminar flow of the sterile air supplied from above, so that "sterile air curtains" form around the containers. For this purpose, the space between the annular element and hood elements are preferably charged with sterile air.

In a further embodiment of the invention, partitions are provided, in each case, for separating the treatment areas, which partitions, in each case, have a foot at their lower end. These feet are preferably configured as a sealing element. In an advantageous embodiment of the invention, the partitions fill the entire cross section of the channel down to the annular element. In this manner, it is reliably ensured that the individual media distribution spaces are sealed off from one another. It is obvious that the width of the feet of the fixed partitions is greater than the diameter of the apertures in the moving annular element.

To improve the laminar sterile air flows required for protection against renewed germ formation, around the sterilised containers, according to a further embodiment of the invention, at least one suction unit is provided below the transporting device, which sucks up the sterile air and optionally incoming external air, so that it certainly cannot reach the open containers or their walls and edges.

BRIEF DESCRIPTION OF THE DRAWING

The invention will be described in more detail hereinafter with the aid of drawings showing only one preferred embodiment. In the drawings.

DETAILED DESCRIPTION OF THE INVENTION

Figure 1:
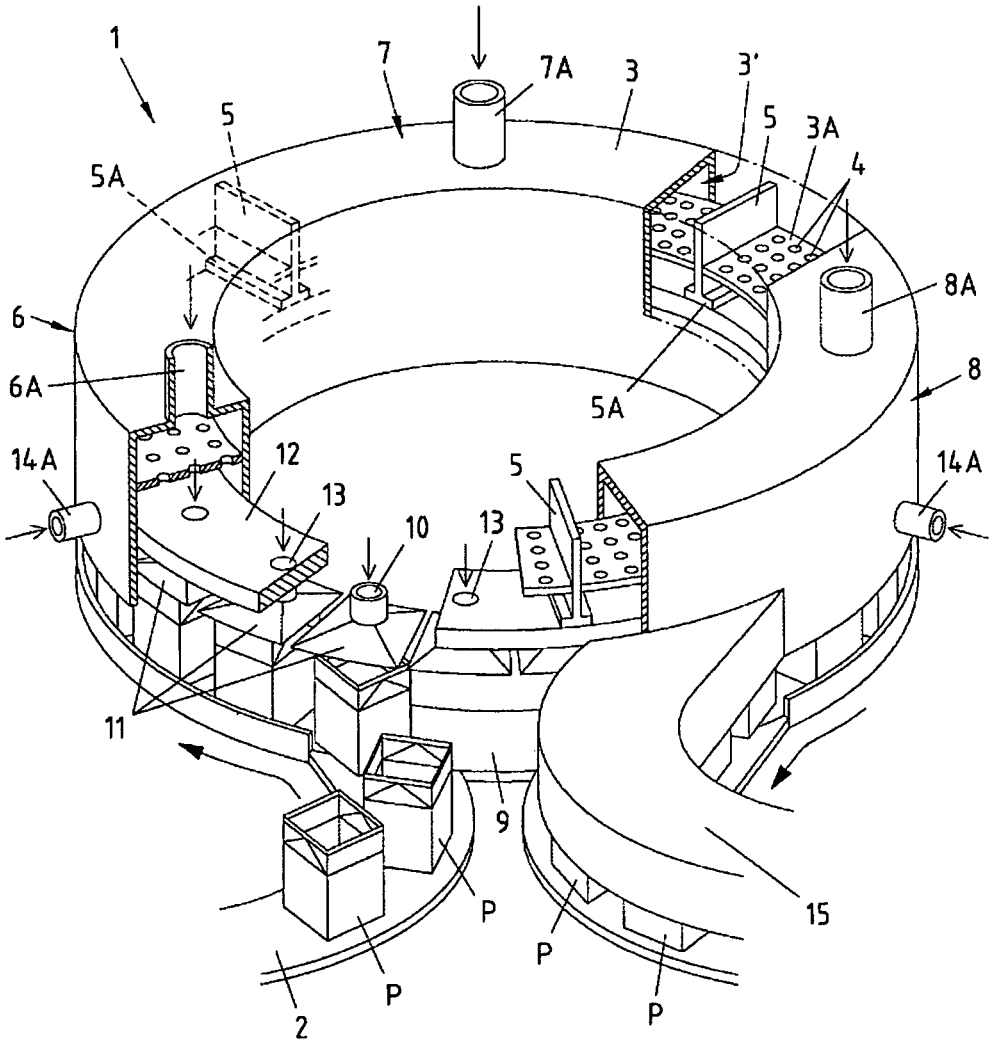
FIG. 1 shows a device according to the invention in a perspective view.

In the shown and, in so far preferred, embodiment, the device according to the invention is designed for sterilising containers P which stand upright, are open at the top and transported continuously one behind the other, as a round runner. The latter consists firstly and substantially of a housing 1, in which the containers P transported one behind the other are fed in via a transporting device 2. In this case, the casing of the housing 1 forms a channel 3, the upper region of which is configured as a media distribution space 3'. The fixed channel 3 is sealed upwardly and to the outsides by the wall of the channel 3 and downwardly by a fixed plate 3A, which is provided with a large number of apertures 4. The precise arrangement, size and number of the apertures 4, may vary in this case depending on the treatment area and the respectively necessary conditions.

Partitions 5, which are also arranged in a fixed manner in the interior of the channel 3, divide the latter into a preheating area 6, a sterilising area 7 and a drying area 8. To charge the treatment areas with the required process media, they have corresponding inlets 6A, 7A and 8A.

To seal the fixed partitions 5, each partition 5 comprises, on its lower side, a widened foot 5A, which is configured as a sealing element and seals the individual media distribution spaces 3' from one another. The width of the foot 5A is constantly wider, in this case, than that of the bores 13 in the moving annular element 12 in order to reliably rule out an exchange of the different process media. This applies, in particular, to production interruptions, in other words machine downtimes.

The transporting of the containers P in the interior of the device takes place by means of a transporting wheel 9, which rotates in the direction of the arrows, not shown in more detail. In this case, provided above each container, centrally above it, are tubular nozzles 10, through which the medium from the respective medium distribution space 3' arrives in the open containers P along arrows not designated in more detail, as emerges, in particular from FIGS. 2 and 3, showing the device according to the invention in a vertical section longitudinally and transversely to the transporting direction.

So the respective process medium can now be supplied in a defined manner to the respective container P, hood elements 11 are provided, which are arranged centrally over the containers P which are transported one behind the other, at a corresponding spacing. In the shown, and in so far preferred, embodiment, the hood elements are provided below an annular element 12, which, preferably rigidly coupled to the transporting wheel 9, moves at the same speed as the containers P located below it. The annular element 12 comprises bores 13 with a corresponding diameter for the passage of the process media above the tubular nozzles 10, as emerges clearly from FIGS. 2 and 3. The precise shape of the hood elements 11 can clearly be seen there. Owing to the shape of the hood elements 11, the process media upwardly leaving the container P are deflected such that they flow off over the edges and outsides of the container P.

It is obvious that the gaps between the fixed housing 1 and the moving annular element 12 are sealed with sealing elements (not shown).

Figure 2:
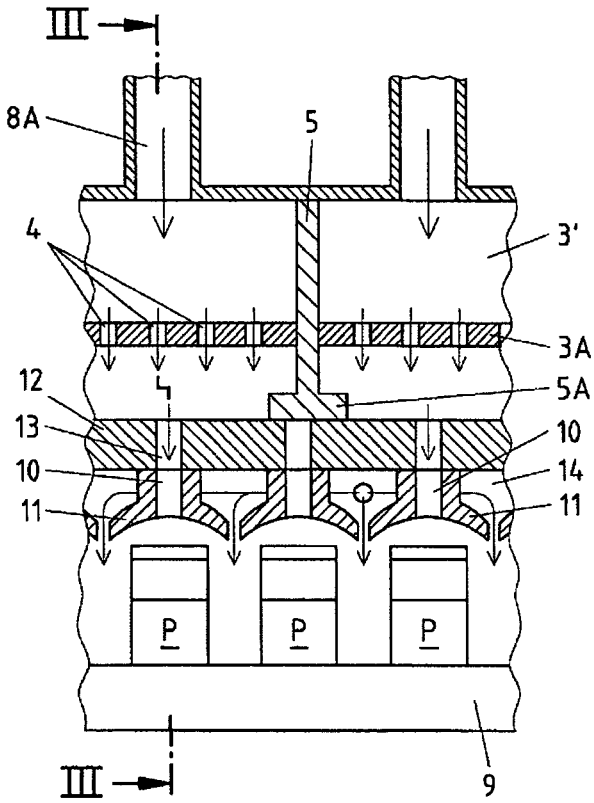
FIG. 2 schematically shows the inner structure of the device according to the invention in vertical section and FIG. 3 shows a cross section along the line III-III from FIG. 2.
Figure 3:
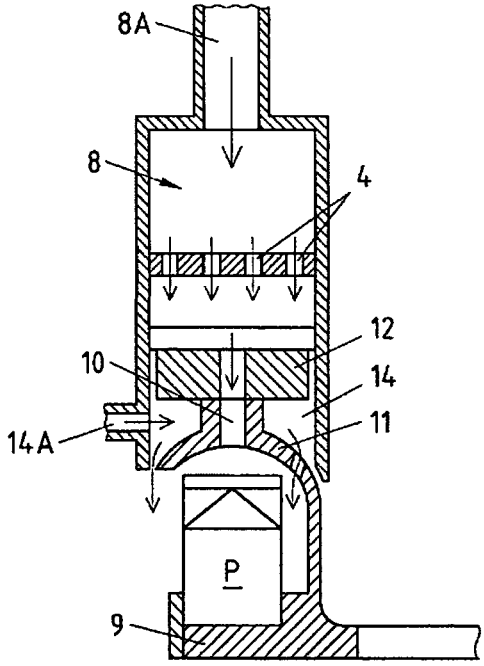

It can also be seen from FIGS. 2 and 3 that the space 14 between the annular element 12 and hood elements 11 can be charged with sterile air. For this purpose, the housing has corresponding sterile air inlets 14A. Owing to the downwardly directed laminar flow of the sterile air, sterile air curtains form, which reliably prevent penetration of extraneous air, dust or the like into the interior of the housing 1. Even if, as shown in FIG. 1, the housing has a peripheral gap on the outside, which is required for cleaning and maintenance purposes, the device according to the invention operates extremely reliably, so no problems of any type for the containers P sterilised therein can occur.

The invention claimed is:

1. A device for sterilising containers, said device comprising:

a) a housing having a plurality of treatment areas arranged one behind the other, wherein said treatment areas are separated by partitions, and wherein each of said partitions has a foot at its lower end; and b) a transporting device having a large number of receiving places arranged one behind the other, wherein said transporting device or its parts forms the base of said housing, and further wherein said housing comprises a fixed channel, comprising an upper region and a lower region, wherein said fixed channel is open toward the bottom for the passage of the containers, and wherein the upper region of the channel in each treatment area comprises at least one media distribution space with apertures toward the bottom, and further wherein said device comprises distribution members coupled to said transporting device, wherein said distribution members are arranged on an annular member and wherein said partitions fill the entire cross section of said fixed channel down to the annular member.

2. The device according to claim 1, wherein the transporting device has a rotating system comprising a transporting wheel receiving the containers and further wherein housing is annular.

3. The device according to claim 1, wherein the containers are transported individually one behind the other.

4. The device according to claim 1, wherein a plurality of containers standing next to one another are transported, in each case, one behind the other.

5. The device according to claim 1, wherein each distribution member has a tubular nozzle arranged centrally over the associated container.

6. The device according to claim 1, further comprising a plurality of hood elements, wherein each of said hood elements is located above each container, and wherein each of said hood elements is rigidly connected to the annular member.

7. The device according to claim 6, wherein the hood elements are configured such that the process media leaving the container upwardly are deflected in such a way that they flow off downwardly over the edges and outsides of the containers.

8. The device according to claim 1, wherein each foot of said partition is configured as a sealing element.

9. The device according to claim 6, wherein the space between the annular member and hood elements can be charged with sterile air.

* * * * *